US009176442B2

(12) United States Patent
Nakayama et al.

(10) Patent No.: US 9,176,442 B2
(45) Date of Patent: Nov. 3, 2015

(54) ROLLER, HEATING MEMBER, AND IMAGE HEATING APPARATUS EQUIPPED WITH ROLLER AND HEATING MEMBER

(71) Applicant: CANON KABUSHIKI KAISHA, Tokyo (JP)

(72) Inventors: Toshinori Nakayama, Kashiwa (JP); Hiroto Sugimoto, Toride (JP); Masayuki Tamaki, Abiko (JP); Koichi Kakubari, Toride (JP); Katsuhisa Matsunaka, Inagi (JP); Yutaka Arai, Kawasaki (JP); Jun Miura, Kawasaki (JP); Takeshi Suzuki, Yokohama (JP); Naoki Akiyama, Toride (JP); Shigeaki Takada, Abiko (JP); Yasuhiro Miyahara, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/553,115

(22) Filed: Nov. 25, 2014

(65) Prior Publication Data

US 2015/0147101 A1 May 28, 2015

(30) Foreign Application Priority Data

Nov. 28, 2013 (JP) ..... 2013-246806
Jun. 30, 2014 (JP) ..... 2014-135333

(51) Int. Cl.
*G03G 15/20* (2006.01)

(52) U.S. Cl.
CPC ..... *G03G 15/206* (2013.01); *G03G 15/2057* (2013.01)

(58) Field of Classification Search
CPC ..... G03G 15/2053; G03G 15/2057; G03G 15/2089; G03G 2215/2016; G03G 15/206
USPC ..... 399/328, 329, 330, 333
See application file for complete search history.

(56) References Cited

U.S. PATENT DOCUMENTS 6,007,657 A * 12/1999 Eddy et al.
2011/0217092 A1* 9/2011 Sekihara et al. ..... 399/328
2012/0014726 A1* 1/2012 Sekihara et al. ..... 399/333
2014/0334857 A1* 11/2014 Hayase ..... 399/329

FOREIGN PATENT DOCUMENTS

JP 2002-114860 A 4/2002
JP 2009-109997 A 5/2009

* cited by examiner

*Primary Examiner* — Sophia S Chen
(74) *Attorney, Agent, or Firm* — Canon USA, Inc. IP Division

(57) ABSTRACT

An image heating apparatus includes an endless belt configured to heat an image on a sheet at a nip potion, a heat generation device configured to cause the belt to generate heat, a nip forming member configured to form the nip portion between the nip forming member and the belt, and a pressing roller configured to press an inner surface of the belt toward the nip forming member, the pressing roller including an elastic porous layer containing a plurality of filler particles, wherein a thermal conductivity of the elastic porous layer in an axial direction of the pressing roller is in a range of 6 times to 900 times a thermal conductivity of the elastic porous layer in a radial direction of the pressing roller.

17 Claims, 15 Drawing Sheets

ROLLER, HEATING MEMBER, AND IMAGE HEATING APPARATUS EQUIPPED WITH ROLLER AND HEATING MEMBER

BACKGROUND

1. Field of the Invention

The present disclosure relates to a roller, a heating member, and an image heating apparatus equipped with the roller and the heating member, which are configured to heat an image on a sheet. The image heating apparatus is used in image forming apparatuses, such as a copying machine, a printer, a facsimile machine, and a multifunction peripheral equipped with a plurality of functions including copying, printing, and facsimile. Further, the present disclosure is directed to preventing or reducing a partial increase in temperature of a belt and to preventing or reducing a partial increase in temperature of a heating member.

2. Description of the Related Art

Image forming apparatuses, such as electrophotographic apparatuses and electrostatic recording apparatuses, are equipped with a fixing apparatus (image heating apparatus) as a unit for heating and fixing an image formed on a sheet. Also, in recent years, there have been proposed fixing apparatuses in which a heating element is provided in a fixing belt (heating rotary member) itself from the viewpoint of energy saving. Such fixing apparatuses, having a configuration with a low thermal capacity, do not require a long warming-up time and, therefore, can operate with reduced power.

In a fixing apparatus discussed in Japanese Patent application Laid-Open No. 2009-109997, an elastic roll is located inside a heating belt (heating rotary member) equipped with a resistance heat generation layer. This configuration enables a nip portion to be formed between the elastic roll and a pressure roll via the heating belt. In addition, Japanese Patent application Laid-Open No. 2009-109997 discusses such a configuration that the elastic roll is made of a foam material. This configuration enables a heat quantity of the resistance heat generation layer to be efficiently used for image fixation and thus can reduce a warming-up time.

However, the fixing apparatus discussed in Japanese Patent application Laid-Open No. 2009-109997 has an issue in that the use of a foam material for the elastic roll may decrease not only the thermal conductivity in a radial direction of the elastic roll but also the thermal conductivity in an axial direction thereof. In other words, in a case where the fixing apparatus continuously performs a fixing process using sheets with a size narrower than the width of the heating belt, regions of the heating belt outside the sheet width in the width direction may increase in temperature. Therefore, it is desirable that the fixing apparatus is configured to have a uniform thermal effect with the improved thermal conductivity in the axial direction of the elastic roll to reduce an increase in temperature of the above-mentioned regions.

SUMMARY

According to an aspect of the present disclosure, an image heating apparatus includes an endless belt configured to heat an image on a sheet at a nip potion, a heat generation device configured to cause the belt to generate heat, a nip forming member configured to form the nip portion between the nip forming member and the belt, and a pressing roller configured to press an inner surface of the belt toward the nip forming member, the pressing roller including an elastic porous layer containing a plurality of filler particles, wherein a thermal conductivity of the elastic porous layer in an axial direction of the pressing roller is in a range of 6 times to 900 times a thermal conductivity of the elastic porous layer in a radial direction of the pressing roller.

Further features of the present invention will become apparent from the following description of exemplary embodiments with reference to the attached drawings.

DESCRIPTION OF THE EMBODIMENTS

Various exemplary embodiments, features, and aspects of the disclosure will be described in detail below with reference to the drawings. In the following exemplary embodiments, an image forming apparatus, to which the present invention can be applied, is described while taking, as an example, a tandem-type full-color laser beam printer using an electrophotographic process.

[Image Forming Apparatus]

Figure 1:
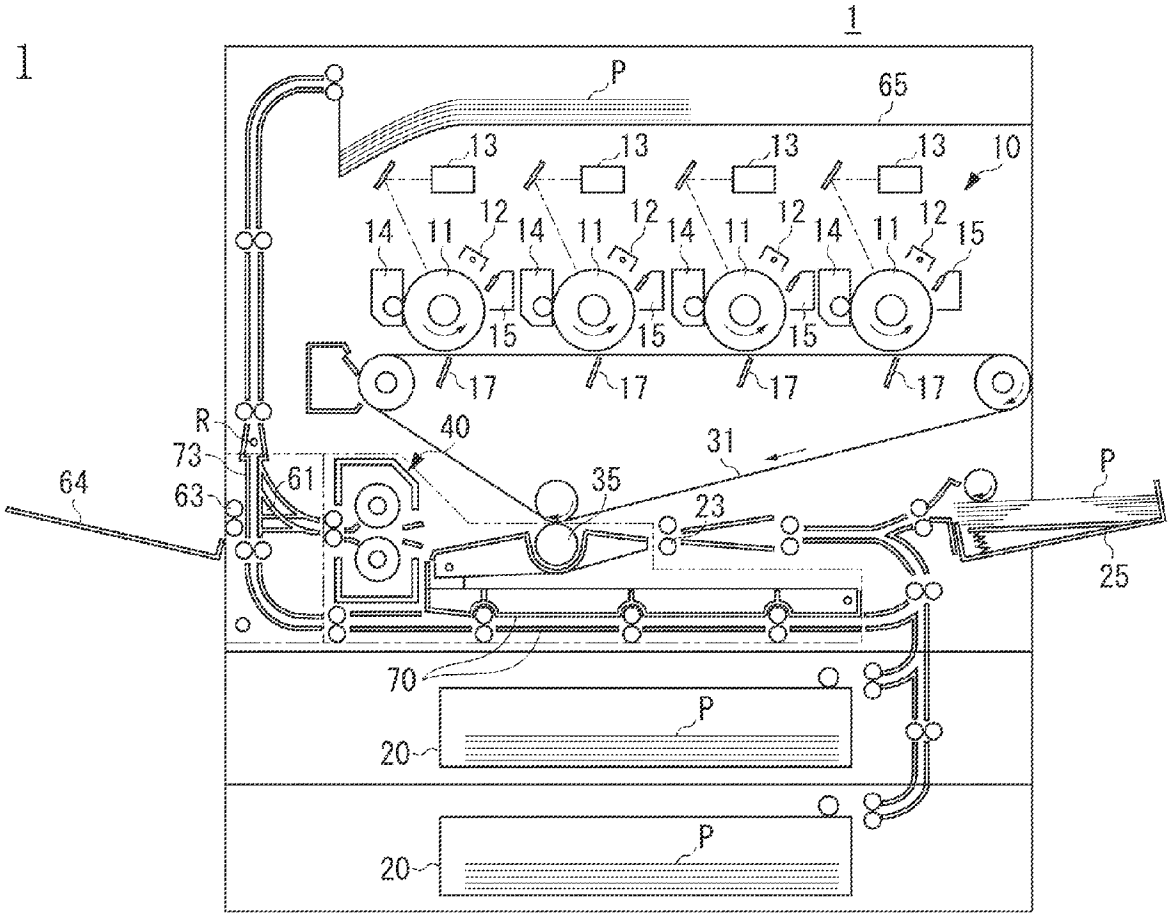
FIG. 1 is a sectional view illustrating a configuration of an image forming apparatus according to a first exemplary embodiment.

First, a configuration of an image forming apparatus is described with reference to FIG. 1. FIG. 1 is a sectional view illustrating a configuration of a full-color laser beam printer, which is an example of the image forming apparatus according to a first exemplary embodiment. Hereinafter, the full-color laser beam printer is simply referred to as a "printer 1".

FIG. 1 is a sectional view taken along a conveyance direction of a sheet P, illustrating a configuration of the printer 1. The sheet P is used to form a toner image T thereon. Specific examples of the sheet P include plain paper, a plastic sheet-like member, thick paper, and an overhead projector film.

As illustrated in FIG. 1, the printer 1 is equipped with an image forming unit 10, which is capable of forming toner images T of respective colors, including yellow (Y), magenta (M), cyan (C), and black (Bk). The image forming unit 10 includes four photosensitive drums 11 corresponding to the respective colors Y, M, C, and Bk arranged in this order from the left side as viewed in FIG. 1. The four photosensitive drums 11 and the surrounding portions have similar configurations except for colors of developers to be used (hereinafter, developer being referred to as "toner"). Therefore, in the following description, only the portions surrounding the photosensitive drum 11 corresponding to color Bk is described as an example, and the portions corresponding to the other colors are assigned with the respective same reference numerals and are thus omitted from description.

The photosensitive drum 11 is driven to rotate in the direction of arrow (counterclockwise in FIG. 1) by a drive source (motor) (not illustrated). The portions surrounding the photosensitive drum 11 include a charging device 12, a laser scanner 13, a developing device 14, a cleaner 15, and a primary transfer blade 17 arranged in this order along the rotational direction of the photosensitive drum 11.

The charging device 12 charges in advance the outer surface of the photosensitive drum 11, which is an electrophotographic photoreceptor. Then, the laser scanner 13 forms, on the photosensitive drum 11, an electrostatic latent image corresponding to image information. The developing device 14 develops the electrostatic latent image into a black toner image. In this instance, similar processes are performed for the other colors. Then, the primary transfer blades 17 sequentially primarily transfer toner images formed on the respective photosensitive drums 11 onto an intermediate transfer belt 31, which is an image bearing member. After the primary transfer, the cleaner 15 removes toner that remains on the photosensitive drum 11 without being transferred. In this way, the surface of the photosensitive drum 11 is made clean, and thus becomes ready for the next image formation.

On the other hand, a sheet feeding mechanism (not illustrated) feeds sheets P placed on a sheet cassette 20 or a multi feed tray 25 on a sheet-by-sheet basis and conveys each sheet P to a registration roller pair 23. The registration roller pair 23 temporarily stops the sheet P and corrects any skew of the sheet P with respect to the conveyance direction into a correct orientation. Then, the registration roller pair 23 feeds the sheet P in between the intermediate transfer belt 31 and a secondary transfer roller 35 in synchronization with the toner image T on the intermediate transfer belt 31. The secondary transfer roller 35, which is a transfer member, transfers the color toner image T on the intermediate transfer belt 31 onto the sheet P. After that, the sheet P is conveyed to a fixing apparatus 40. Then, the fixing apparatus 40 heats and presses the image T on the sheet P to fix the image T to the sheet P.

In a case where an image T is to be formed on only one side of the sheet P, the sheet P is discharged to the outside of the printer 1 via a discharge roller pair 63 due to a changeover operation of a changeover flapper (diverter) 61. The discharge destination of the sheet P is any one of a discharge tray 64 mounted on the side surface of the printer 1 and a discharge tray 65 mounted on the top surface of the printer 1. When the changeover flapper 61 is located at a position indicated with broken line, the sheet P is discharged face-up (with the image T positioned upward) onto the discharge tray 64. When the changeover flapper 61 is located at a position indicated with solid line, the sheet P is discharged face-down (with the image T positioned downward) onto the discharge tray 65.

In a case where images T are to be respectively formed on two sides of the sheet P, the sheet P onto which an image T has already been fixed by the fixing apparatus 40 is first guided upward by the changeover flapper 61, which is located at the position indicated with solid line. Then, when the trailing edge of the sheet P has reached an inversion point R, the sheet P is inverted between front and back sides by being reversely conveyed by a conveyance path 73. Then, the sheet P is conveyed to the registration roller pair 23 via a two-sided conveyance path 70, and is subjected to the same process as that in the image formation for one side. Thus, the sheet P is made to have a new image T formed on a surface opposite to the surface to which the first image T has already been fixed, and is then discharged to the discharge tray 64 or the discharge tray 65. The configuration including the changeover flapper 61 and the conveyance path 73 is an example of an inversion unit.

[Fixing Apparatus]

Figure 2:
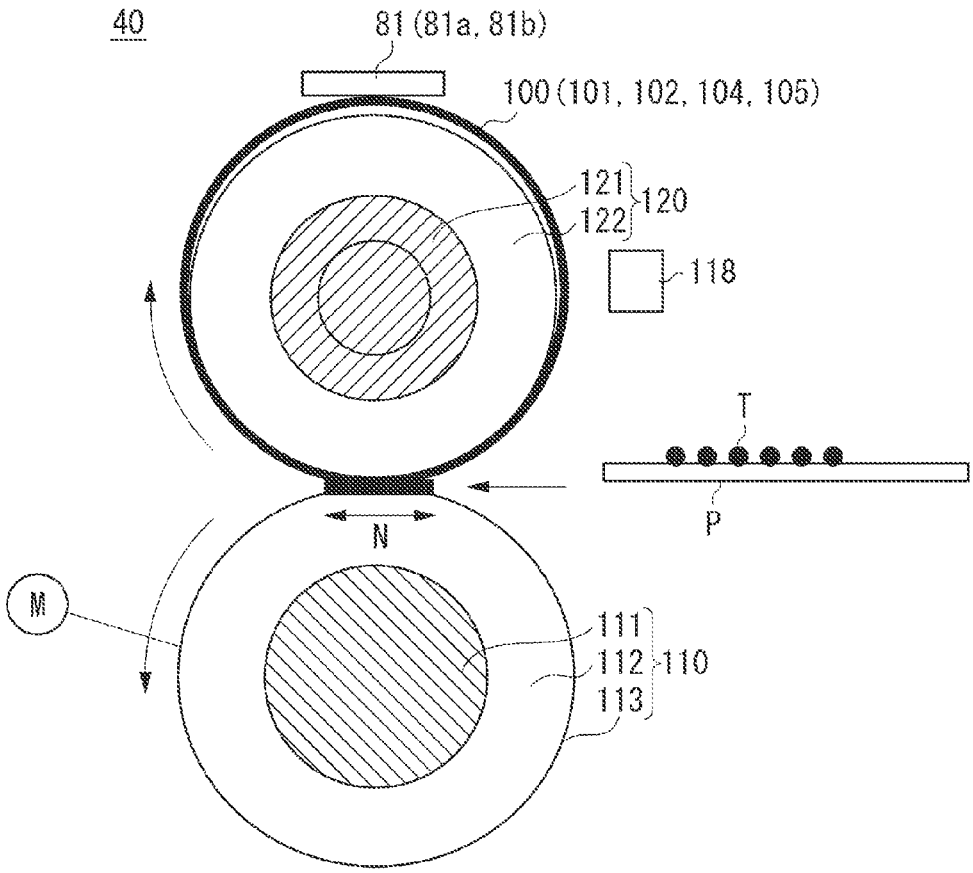
FIG. 2 is a sectional view illustrating a configuration of a fixing apparatus according to the first exemplary embodiment.
Figure 3:
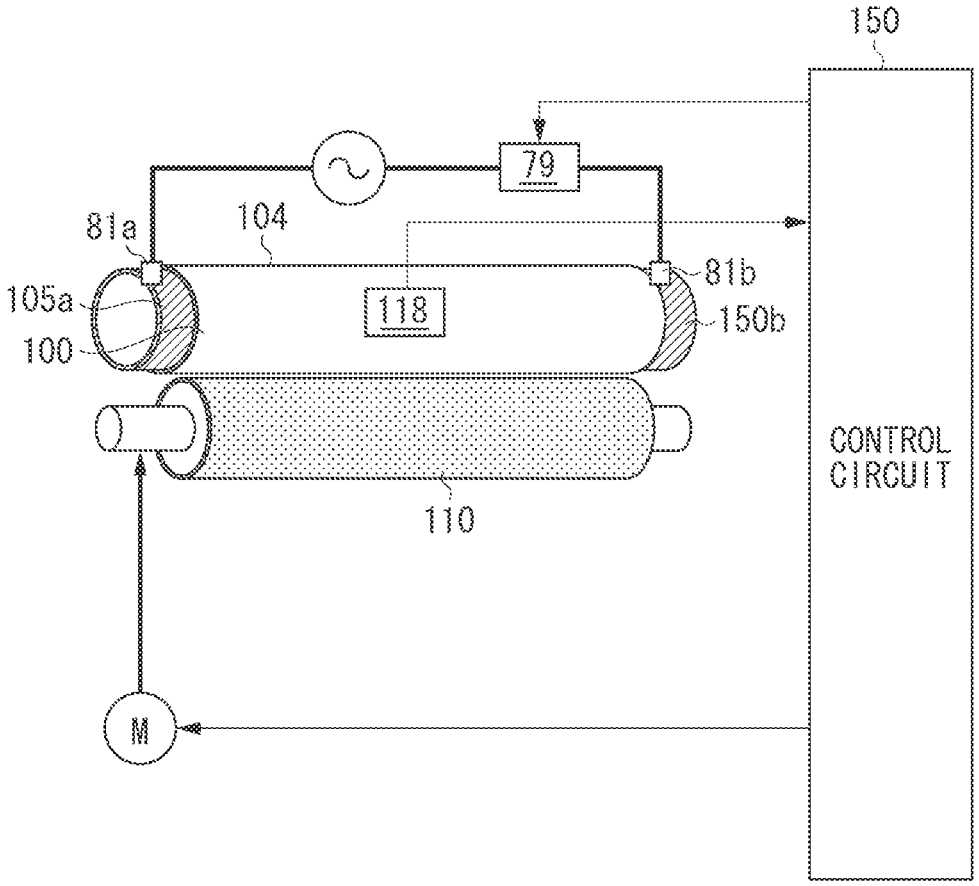
FIG. 3 is an explanatory diagram illustrating the details of energization to the fixing apparatus according to the first exemplary embodiment.

Next, a configuration of the fixing apparatus 40, which serves as an image heating apparatus used in the printer 1, is described in detail with reference to the drawings. FIG. 2 is a sectional view illustrating the configuration of the fixing apparatus 40. FIG. 3 is an explanatory diagram illustrating a configuration for energization to the fixing apparatus 40. In FIG. 3, an elastic roller 120 is omitted from the illustration.

The present exemplary embodiment employs a fixing apparatus 40 of the film fixation type, in which a nip portion N is formed between a fixing film 100, serving as a belt, and a pressure roller 110 and an image T on the sheet P is heated and pressed at the nip portion N. The fixing apparatus 40 of the film fixation type is excellent in temperature rise performance since the fixing apparatus 40 has a small thermal capacity configuration, and is thus characterized in that the fixing apparatus 40 is capable of operating with small energy. Furthermore, the present exemplary embodiment employs an elastic roller 120 having a sponge-like elastic layer (elastic porous layer) 122, which serves as a pressure member configured to press the fixing film 100 against the pressure roller 110. Therefore, the heat of the fixing film 100 is not easily transferred toward the center of the diameter of the elastic roller 120 (toward a core metal 121). Thus, the heat of the fixing film 100 can be efficiently used for heat fixation of the image T. In this way, the present exemplary embodiment is directed to preventing or reducing the heat of the fixing film 100 (heating member) from transferring toward the inner side in the radial direction of the fixing film 100. Accordingly, the present exemplary embodiment is applied to the fixing apparatus 40 including a heating member that generates heat, such as the fixing film 100. The configuration of the fixing apparatus 40 is described below.

The fixing film 100, which serves a heating film (heating member), is a cylindrical (endless) film (belt) that generates heat by electrical resistance during energization to a heat generation layer 102 and heats an image T on the sheet P at the nip portion N. In the present exemplary embodiment, the outer diameter of the fixing film 100 is about 30 mm and the length thereof in the width direction (the near-far direction as viewed in FIG. 2) is about 300 mm. The elastic roller 120 is located internally in the fixing film 100 in such a manner that the elastic roller 120 contacts the inner surface of the fixing film 100. The details of a layer configuration of the fixing film 100 are described below.

The pressure roller 110, which serves as a nip forming member, is a roller member that forms the nip portion N between the fixing film 100 and the pressure roller 110. The pressure roller 110 has such a multi-layer structure that an elastic layer 112 is layered on a metal core 111 made of metal and a release layer 113 is layered on the elastic layer 112. Examples of the material of the metal core 111 include stainless steel (SUS), sulfur and sulfur-compound free-cutting steel (SUM), and aluminum (Al). Examples of the elastic layer 112 include an elastic solid rubber layer, an elastic sponge rubber layer, and an elastic foam rubber layer. Examples of the material of the release layer 113 include fluororesins. The fluororesins include, for example, polytetrafluoroethylene (PTFE), tetrafluoroethylene/perfluoroalkylvinylether copolymer (PFA), and tetrafluoroethylene/hexafluoropropylene copolymer (FEP).

The pressure roller 110 in the present exemplary embodiment is a cylindrical roller with an outer diameter of about 30 mm and a length of about 300 mm in the width direction. More specifically, the elastic layer 112 made of insulating silicone rubber with a thickness of about 3 mm is provided on the metal core 111 made of stainless steel, and the release layer 113 made of PFA is provided as a surface layer for the elastic layer 112.

In addition, the metal core 111 is mechanically connected to a motor M (drive unit). As the motor M is energized to rotate, the pressure roller 110 rotates in the direction of arrow in FIG. 2 (counterclockwise). The pressure roller 110, when rotating, causes the fixing film 100 to be driven to rotate in the direction of arrow in FIG. 2 (clockwise) due to the friction at the nip portion N. Also, as the fixing film 100 rotates, the elastic roller 120, which contacts the inner surface of the fixing film 100, is driven to rotate in the direction of arrow in FIG. 2 (clockwise) due to the friction against the inner surface of the fixing film 100.

The elastic roller 120, which serves as a pressing roller, is a roller that presses the fixing film 100 from the inner surface thereof toward the pressure roller 110. The elastic roller 120 has such a structure that the elastic layer 122 is provided on the outer surface of the core metal 121. Since the outer diameter of the elastic roller 120 is slightly smaller than the inner diameter of the fixing film 100, the elastic roller 120 is able to be inserted into the inner circumference of the fixing film 100. Furthermore, depending on the flexibility of the elastic layer 122, an elastic roller 120 with a diameter slightly larger than the inner diameter of the fixing film 100 can be inserted into the inner circumference of the fixing film 100 with the elastic roller 120 compressed. With this configuration, the entire inner circumferential surface of the fixing film 100 contacts the entire outer circumferential surface of the elastic roller 120, so that the positional relationship between the fixing film 100 and the elastic roller 120 does not easily vary. In the present exemplary embodiment, a flange (not illustrated) is mounted on each of the two sides in the width direction of the fixing film 100, so that the fixing film 100 is prevented from moving in a one-sided manner in the axial direction of the elastic roller 120.

The elastic roller 120 in the present exemplary embodiment is configured to be inserted into the inside of the fixing film 100, and the positional relationship between the elastic roller 120 and the fixing film 100 is not fixed by adhesive or the like. Therefore, even if a circumferential velocity difference occurs between the core metal 121 and the fixing film 100 due to a strong external force exerted on the elastic roller 120, since the elastic roller 120 and the fixing film 100 are slidable with respect to each other, the elastic layer 122 is prevented from twisting.

The core metal 121 is a shaft-like member made of metal, such as iron or aluminum. In the present exemplary embodiment, the core metal 121 is made of stainless steel. The two end portions in the axial direction of the core metal 121 are rotatably held by a pressure mechanism (not illustrated) via rotation bearings (not illustrated). As the pressure mechanism presses the two end portions of the core metal 121 toward the pressure roller 110, the elastic roller 120 presses the pressure roller 110 via the fixing film 100 at a predetermined pressing force. Then, the elastic layer 112 is deformed with the pressure roller 110 pressed, so that a fixing nip portion N having a predetermined width is formed. In the present exemplary embodiment, the pressure force exerted by the pressure mechanism (not illustrated) is about 156.8 Newton (N) at one end portion, and the total pressure force is about 313.6 N (about 32 kgf).

Figure 6:
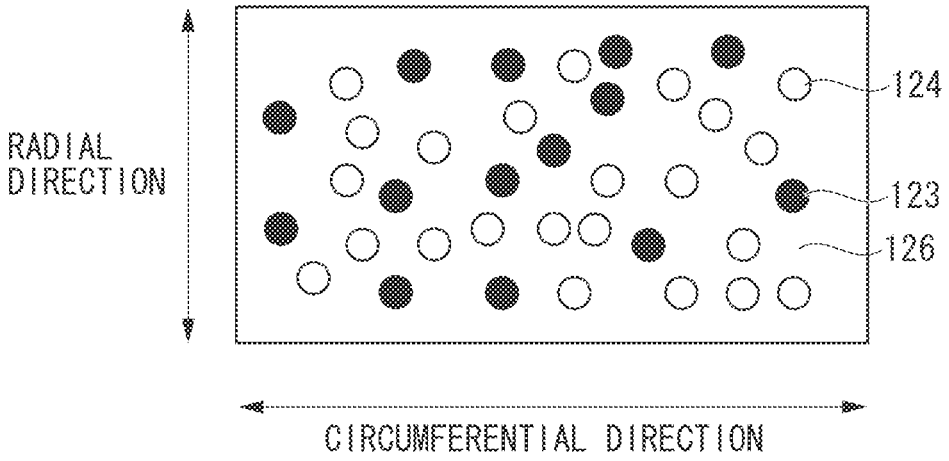
FIG. 6 is a sectional view of an elastic layer taken along the circumferential direction of the elastic roller.
Figure 7:
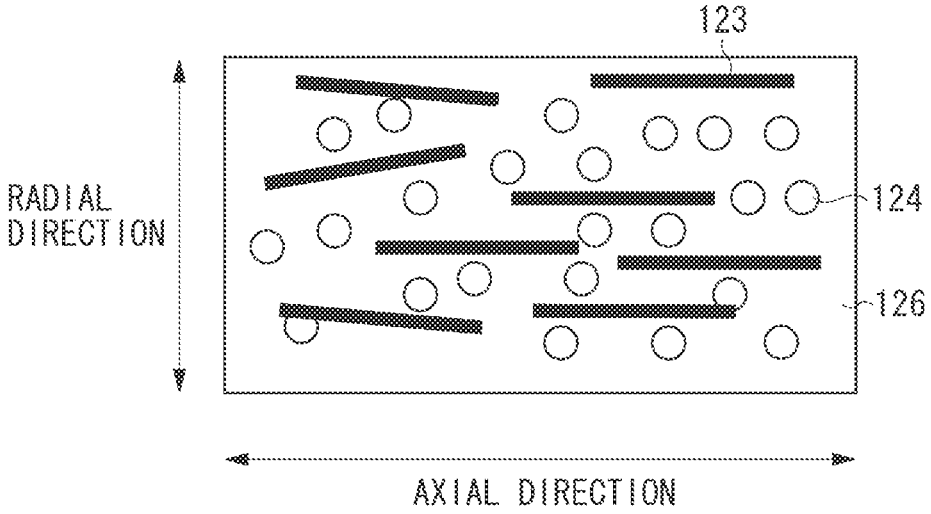
FIG. 7 is a sectional view of the elastic layer taken along the axial direction of the elastic roller.

FIG. 6 is a sectional view of the elastic layer 122 taken along the circumferential direction section of the elastic roller 120. FIG. 7 is a sectional view of the elastic layer 122 taken along the axial direction of the elastic roller 120.

The elastic layer 122 contains, as a base, a base polymer 126 made of silicone rubber. The thickness of the elastic layer 122 is not restricted as long as the nip portion N can be formed with a predetermined width, but may be desirably 2 mm to 10 mm. In the present exemplary embodiment, the thickness of the elastic layer 122 is set to about 3 mm in such a manner that the width of the nip portion N (the width in the direction of horizontal arrow in FIG. 2) becomes about 5 mm. As illustrated in FIGS. 6 and 7, the elastic layer 122 is provided with a plurality of voids 124 and contains, as additives, acicular fillers (filler particles) 123. With this configuration of the elastic layer 122, the elastic roller 120 has such a configuration that the thermal conductivity is high in the longitudinal direction thereof and low in the radial direction thereof. The details of the elastic layer 122 are described below.

In a case where a member contacts the fixing film 100, the member can perform more heat exchange as the area of contact with the fixing film 100 is larger. Therefore, in order to reduce the temperature rise at the sheet non-passage portion of the fixing film 100, it is desirable that the member contacts a larger area of the fixing film 100.

Accordingly, in the present exemplary embodiment, the area of contact between the elastic roller 120 and the fixing film 100 is set larger than the area of contact between the fixing film 100 and the pressure roller 110 at the nip portion N. In other words, the elastic roller 120 has a longer length of contact with the fixing film 100 in the circumferential direction thereof than the pressure roller 110.

In the present exemplary embodiment, the elastic roller 120, when elastically deformed by receiving the pressing force from the pressure mechanism, contacts about 50% of the inner circumferential surface of the fixing film 100. In other words, the elastic roller 120 is located such that the length of contact with the fixing film 100 in the circumferential direction thereof is about 45 mm. Thus, the length of contact between the elastic roller 120 and the fixing film 100 is 9 times the length of contact between the fixing film 100 and the pressure roller 110 at the nip portion N (about 5 mm). However, the length of contact between the fixing film 100 and the elastic roller 120 is not limited to the above-mentioned value. As long as the elastic roller 120 has a longer length of contact with the fixing film 100 than the pressure roller 110, the dimension and location of the elastic roller 120 can be arbitrarily designed. For example, the inner diameter of the fixing film 100 may be set equal to the outer diameter of the elastic roller 120 such that the elastic roller 120 contacts the entire inner circumference of the fixing film 100.

Therefore, even if the same material is used for the pressure roller 110 and the elastic roller 120, the elastic roller 120 can more efficiently prevent the temperature rise of the sheet non-passage portion of the fixing film 100 than the pressure roller 110.

A thermistor 118, which is a contactless temperature detection unit, detects the temperature of the surface of the fixing film 100. Then, the thermistor 118 transmits an output corresponding to the detected surface temperature to a control circuit 150. The details of the control circuit 150 are described below.

Power feeding members 81 (81*a* and 81*b*) are a pair of members that make electrical connection by contacting the fixing film 100. As illustrated in FIG. 3, the power feeding member 81*a* contacts an electrode 105*a* of the fixing film 100 at one end side in the width direction of the fixing film 100. The power feeding member 81*b* contacts an electrode 105*b* of the fixing film 100 at the other end side in the width direction of the fixing film 100.

In the present exemplary embodiment, each of the power feeding members 81 is a plate-spring-like member made of stainless steel and is located while being pressed toward the outer circumferential surface of the fixing film 100. Thus, the power feeding members 81 contact the fixing film 100 while sliding on the fixing film 100 rotating. In addition, the shape of the power feeding members 81 is not limited to a plate-spring-like shape. For example, the shape of the power feeding members 81 may be a brush shape that contacts the fixing film 100 while sliding on the fixing film 100, or may be a roller shape that is driven to rotate by the fixing film 100.

As illustrated in FIG. 3, the electrodes 105 (105*a* and 105*b*) are conductive regions of the fixing film 100 that electrically connect to the power feeding members 81 by contacting the power feeding members 81. The electrode 105*a* electrically connects to the power feeding member 81*a* by contacting the power feeding member 81*a*. The electrode 105*b* electrically connects to the power feeding member 81*b* by contacting the power feeding member 81*b*. The electrodes 105 are provided over the entire circumference of the fixing film 100 at both end portions in the width direction (the direction approximately parallel to the axial direction of the pressure roller 110) of the fixing film 100. With the electrodes 105 configured in the above-mentioned shape, the power feeding members 81 constantly electrically connect to the fixing film 100 rotating.

An energization circuit 79, which serves as a heat generation device (power feeding device), is a circuit that supplies power to the fixing film 100 via the power feeding members 81 and the electrodes 105. The power feeding members 81, which are electrically connected to the energization circuit 79, energize the fixing film 100 by contacting the electrodes 105. The method for supplying power to the fixing film 100 includes a method for applying an alternating-current voltage, a method for applying a direct-current voltage, and a method obtained by combining the method for applying an alternating-current voltage and the method for applying a direct-current voltage. The present exemplary embodiment uses a method for applying an alternating-current voltage having an effective value of about 100 V to supply power to the fixing film 100.

As illustrated in FIG. 3, the manner of energization to the fixing apparatus 40 is controlled by the control circuit 150. The control circuit 150 is connected to the thermistor 118, the energization circuit 79, and the motor M and is configured to control the energization circuit 79 and the motor M by outputting signals corresponding to various execution instructions.

The control circuit 150 includes a central processing unit (CPU), which performs computations associated with various control operations, and a non-volatile storage medium, such as a read-only memory (ROM), which stores various programs. The CPU reads and executes programs stored in the ROM to perform various control operations. The control circuit 150 may be an integrated circuit, such as an application specific integrated circuit (ASIC), which serves a similar function.

The control circuit 150 samples an output from the thermistor 118 with a predetermined period, and then reflects the thus-obtained temperature information of the fixing film 100 in energization control to the energization circuit 79. In the present exemplary embodiment, the fixing apparatus 40 is configured to perform control to keep the temperature detected by the thermistor 118 constant in consideration of a temperature used to fix an image onto the sheet P.

Also, the control circuit 150 performs rotation control of the motor M. The control circuit 150 causes the pressure roller 110 and the fixing film 100 to rotate at a predetermined speed via the motor M, thus adjusting the sheet P, which is nipped and conveyed at the nip portion N during the fixing process, to be conveyed at a predetermined process speed.

[Layer Configuration of Fixing Film]

Figure 4:
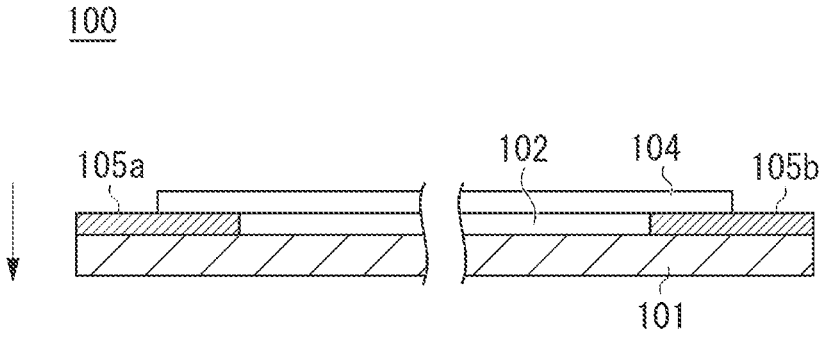
FIG. 4 is a sectional view illustrating a layer configuration of a fixing film.
Figure 5:
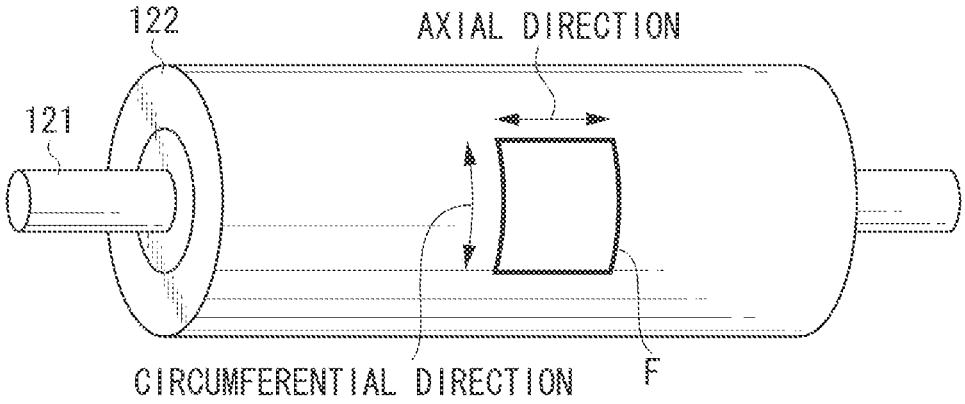
FIG. 5 is an explanatory diagram illustrating a configuration of an elastic roller.

Next, a configuration of the fixing film 100 is described with reference to the drawings. FIG. 4 is a sectional view illustrating a layer configuration of the fixing film 100. In FIG. 4, the direction of arrow indicates the inner side of the fixing film 100. In the present exemplary embodiment, the fixing film 100 has a three-layer composite structure including a base layer 101, a heat generation layer 102, and a release layer 104 in order from the inner side to the outer side. Furthermore, electrodes 105 (105*a* and 105*b*) are arranged at the end portions in the width direction of the fixing film 100 in place of the heat generation layer 102.

The base layer 101, which serves as a base of the fixing film 100, is made of a heat-resistant material. In order to improve the quick start property by reducing the thermal capacity, the thickness of the base layer 101 may be set to 100 μm or less, or desirably, to within a range of 50 μm or more to 20 μm or less. Examples of the heat-resistant material include a resin belt made of polyimide, polyimideamide, PTFE, PFA, FEP, or the like, and a metal belt made of stainless steel (SUS), nickel, or the like.

In the present exemplary embodiment, a cylindrical polyimide belt with a thickness of about 30 μm and a diameter of about 30 mm is used as the base layer 101. In a case where an electrically-conductive material is used as the base layer 101, an insulating layer can be provided between the base layer 101 and the heat generation layer 102.

The release layer 104 is provided to improve the separation property of the sheet P. The release layer 104 can be selectively made of a PFA tube or a PFA coat depending on the required thickness, mechanical strength, and electrical strength. In the present exemplary embodiment, a PFA tube with a thickness of about 20 μm is used as the release layer 104. Furthermore, the release layer 104 is bonded to the heat generation layer 102 by adhesive made of silicone resin.

The heat generation layer 102, which is a resistance heat generation layer, is a resistance heating element obtained by applying, at a uniform thickness onto the base layer 101, a polyimide resin containing carbon as conductive particles. The total resistance value of the heat generation layer 102 is about 10.0 Ω. Accordingly, power that is generated during energization of an alternating power source with a voltage of about 100 V is about 1000 W. The resistance value of the heat generation layer 102 can be arbitrarily determined according to the amount of heat generation required for the fixing apparatus 40, and can be arbitrarily adjusted by the mixture ratio of carbon.

Furthermore, the electrodes 105 are formed at the both end portions of the fixing film 100. The electrodes 105 are connected to the respective ends of the heat generation layer 102. In the present exemplary embodiment, the electrodes 105 are made of a material having a conductive property containing silver or palladium.

[Elastic layer}

Next, the elastic layer 122 of the elastic roller 120, which is a characteristic configuration of the present exemplary embodiment, is described. The fixing apparatus 40 according to the present exemplary embodiment is configured to improve the heat transfer (uniform heat effect) in the width direction of the fixing film 100 by providing the elastic roller 120 on the inner surface of the fixing film 100. Thus, the heat of the fixing film 100 can transfer in the width direction of the fixing film 100 via the elastic roller 120. With this configuration, the fixing apparatus 40 can reduce the temperature rise of the sheet non-passage portion that would occur when a fixing process is continuously performed using sheets P with a size narrower than the width of the fixing film 100. The term "temperature rise of the sheet non-passage portion" here means a phenomenon in which the temperature of a region that does not contact the sheet P (that is located outside the sheet P), of the fixing film 100, rises abnormally along with the execution of the fixing process.

The present exemplary embodiment can provide a fixing apparatus 40 that produces a more excellent effect by arranging the elastic layer 122 of the elastic roller 120 with a characteristic configuration. The characteristic configuration is attained by forming a plurality of voids within the elastic layer 122 and adding a plurality of acicular fillers 123 to the elastic layer 122. With the use of the elastic roller 120 including the thus-configured elastic layer 122, the fixing apparatus 40 can improve the rise time of the fixing process and an effect of reducing the temperature rise of the sheet non-passage portion. Next, a configuration of the elastic layer 122 is described in detail with reference to the drawings.

Figure 8:
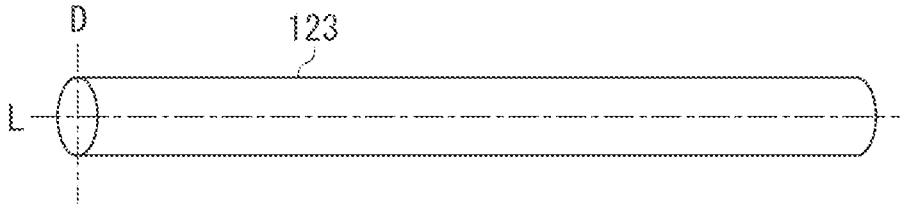
FIG. 8 is an explanatory diagram illustrating a relationship between a diameter D and a length L.

As illustrated in FIGS. 6 and 7, acicular fillers 123 (filler particles) are added to the elastic layer 122 of the elastic roller 120 in the present exemplary embodiment. FIG. 6 mainly facilitates the observation of a section in the diameter D of each acicular filler 123. FIG. 7 mainly facilitates the observation of a portion in the length L of each acicular filler 123. FIG. 8 is an explanatory diagram illustrating the relationship between the diameter D and the length L.

Each acicular filler 123, which serves as a thermal conduction path in the direction of the length L, can increase the thermal conductivity in direction of the length L. Accordingly, the thermal conductivity in the axial direction of the elastic roller 120 can be increased by orienting the acicular fillers 123 along the axial direction of the elastic roller 120.

Also, FIGS. 6 and 7 facilitate the observation of the voids 124. The voids 124 are gaps (cavities) that are formed by, when forming the elastic layer 122 with a base polymer 126, adding an aqueous material soaked with water to a water absorbing polymer and then dehydrating the water absorbing polymer. The voids 124 can lower the thermal conductivity of the elastic layer 122 and decrease the apparent density thereof, thus reducing the volumetric specific heat of the elastic layer 122. The term "apparent density" means a density calculated based on the volume including voids.

In this way, the thermal capacity of the elastic layer 122 is lowered by the voids 124, and the thermal conductivity in the axial direction of the elastic layer 122 is increased by the acicular fillers 123. Accordingly, the elastic layer 122 is configured to have a high thermal conductivity in the axial direction and a low thermal conductivity in the radial direction.

The elastic layer 122 according to the present exemplary embodiment has characteristics described below, thus attaining the shortening of rise time while preventing or reducing the temperature rise of the sheet non-passage portion.

In the elastic layer 122 according to the present exemplary embodiment, the ratio $\lambda 1/\lambda 2$ of a thermal conductivity $\lambda 1$ in the axial direction of the elastic roller 120 to a thermal conductivity $\lambda 2$ in the thickness direction of the elastic roller 120 (the radial direction of the elastic roller 120) is 6 or more and 900 or less. In other words, $\lambda 1$ is 6 times to 900 times $\lambda 2$. Hereinafter, the ratio $\lambda 1/\lambda 2$ is referred to as a "thermal conductivity ratio $\alpha$". The higher thermal conductivity ratio $\alpha$ within the above-mentioned range more uniforms heat in the width direction and more reduces the transfer of heat in the thickness direction. Therefore, the elastic roller 120 can satisfy both of the reduction of the temperature rise of the sheet non-passage portion and the shortening of the rise time.

If the thermal conductivity ratio $\alpha$ is less than 6, the effect of reducing the temperature rise of the sheet non-passage portion may not be sufficiently attained. Also, if the thermal conductivity ratio $\alpha$ is intended to become larger than 900, the proportion of the acicular fillers 123 or the voids 124 in the elastic layer 122 is increased, so that it becomes difficult to form and process the elastic layer 122.

The thermal conductivity ratio $\alpha$ can be obtained in the following way. First, the measurer clips, with a razor, the area of a region F as a sample 125 from an arbitrary portion of the elastic layer 122. Next, the measurer measures the thermal conductivity $\lambda 1$ in the axial direction and the thermal conductivity $\lambda 2$ in the thickness direction each five times by a method described below. Then, the measurer uses averages values of the measurement results to calculate the ratio of the thermal conductivity $\lambda 1$ to the thermal conductivity $\lambda 2$, thus obtaining the thermal conductivity ratio $\alpha$.

Figure 9:
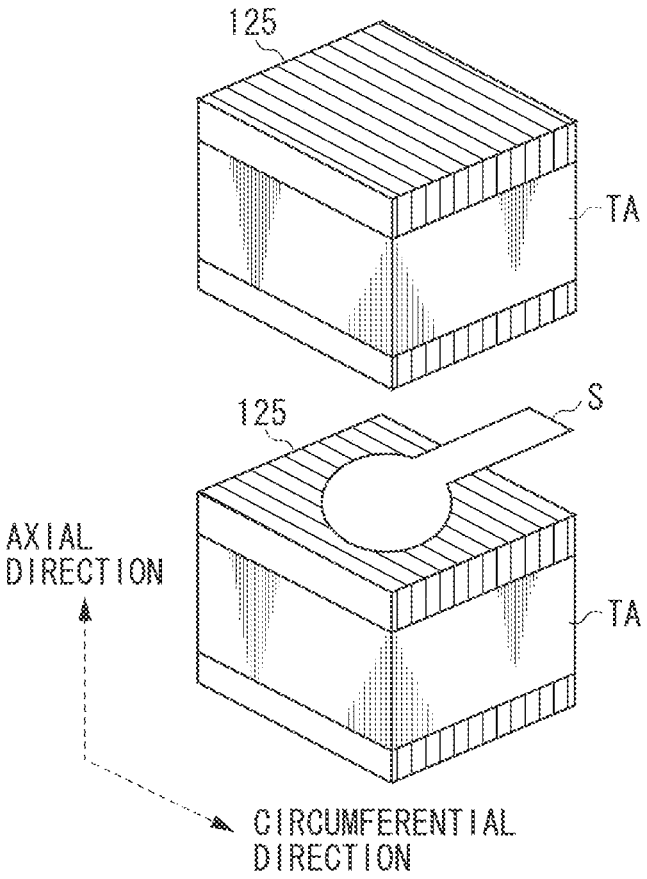
FIG. 9 is an explanatory diagram illustrating a method for evaluation of a thermal conductivity of the elastic layer.

The measurement of the width-direction thermal conductivity $\lambda 1$ and the thickness-direction thermal conductivity $\lambda 2$ of the elastic layer 122 is described with reference to FIG. 9. FIG. 9 is an explanatory diagram illustrating an evaluation method for a thermal conductivity. The measurer clips a plurality of samples 125, each with a circumferential-direction length of 15 mm and a width-direction length of 15 mm, from the elastic layer 122 and laps the plurality of samples 125 on one another, thus producing an evaluation specimen for thermal conductivity with a thickness of about 15 mm, as illustrated in FIG. 9. In this instance, it is desirable to fix the lapped samples 125 in an immovable manner. In the present exemplary embodiment, the measurer fixed the evaluation specimen by a tape TA with a thickness of about 0.07 mm and a width of about 10 mm. In addition, in order to perform accurate measurement, the measurer cut a measured surface and the back of the measured surface by a razor to uniform the flatness of the measured surface. Then, the measurer prepares two evaluation specimens produced in the above-described way.

To measure the width-direction thermal conductivity $\lambda 1$, the measurer sandwiches a sensor S between surfaces of the evaluation specimens perpendicular to the axial direction of thereof, as illustrated in FIG. 9, and performs measurement. To measure the thickness-direction thermal conductivity $\lambda 2$, the measurer performs measurement after changing the orientation of the evaluation specimens in a way similar to the above-mentioned way. The above-described measurement is an anisotropic thermal conductivity measurement using a hot disk method thermophysical properties tester TPA-501 (manufactured by Kyoto Electronics Manufacturing Co., Ltd.).

In this instance, it is desirable that the thermal conductivity in the thickness direction of the elastic layer 122 (the radial direction of the elastic roller 120) is 0.08 W/(m·K) or more and 0.4 W/(m·K) or less. It is more desirable that the thermal conductivity in the thickness direction is 0.2 W/(m·K) or less as the upper limit, and it is much more desirable that the thermal conductivity in the thickness direction is 0.11 W/(m·K) or less as the upper limit. If the thermal conductivity in the thickness direction is intended to become less than 0.08 W/(m·K), the proportion of the acicular fillers 123 or the voids 124 in the elastic layer 122 is increased, so that it becomes difficult to form and process the elastic layer 122.

Also, in a case where the thermal conductivity in the thickness direction of the elastic layer 122 is higher than 0.4 W/(m·K), the effect of shortening rise time cannot be sufficiently attained. In a case where the thermal conductivity in the thickness direction of the elastic layer 122 is 0.2 W/(m·K) or less, it is as low a thermal conductivity as solid-type silicone rubber having no voids. Therefore, the influence of a high thermal conductivity in the thickness direction of the elastic layer 122 due to the addition of the acicular fillers 123 becomes negligibly small. Furthermore, in a case where the thermal conductivity in the thickness direction of the elastic layer 122 is 0.11 W/(m·K) or less, it is a remarkably low thermal conductivity even as compared with various solid rubber materials generally used as a fixing member.

Furthermore, it is desirable that the thermal conductivity in the width direction of the elastic layer 122 (the axial direction of the elastic roller 120) is 0.48 W/(m·K) or more and 360 W/(m·K) or less.

Next, the base polymer 126, the acicular fillers 123, and the voids 124, which are constituent components of the elastic layer 122, are described in detail.

[Base Polymer]

The base polymer 126 of the elastic layer 122 can be obtained by cross-linking and curing addition curable liquid silicone rubber. The addition curable liquid silicone rubber is uncrosslinked silicone rubber including organopolysiloxane (A) having an unsaturated bond, such as a vinyl group, and organopolysiloxane (B) having an Si—H bond (hydride).

In the addition curable liquid silicone rubber, cross-linking and curing proceed by the addition reaction of Si—H to an unsaturated bond, such as a vinyl group, due to heating or the like. The organopolysiloxane (A), which serves as a catalyst to speed up the reaction, generally contains a platinum compound. The liquidity of the addition curable liquid silicone rubber can be adjusted within the scope not impairing the gist of the present invention.

[Acicular Fillers]

The acicular fillers 123 can be made of a material in which the ratio of the length L to the diameter D is large, as illustrated in FIG. 8, in other words, a material having a high aspect ratio. The shape of the bottom surface of each acicular filler 123 may be circular or rectangular, and any orientable material can be used.

Examples of the material satisfying the above-described condition include a pitch-based carbon fiber. In particular, it is desirable in the present exemplary embodiment that a pitch-based carbon fiber with a thermal conductivity λ of 500 W/(m·K) or more is used. Furthermore, it is desirable in the present exemplary embodiment that the pitch-based carbon fiber is in an acicular shape. As a specific shape of the acicular pitch-based carbon fiber, a carbon fiber with a diameter D (average diameter) of 5 to 11 μm and a length L (average length) of 50 μm or more and 1000 μm or less can be provided as an example and can be industrially available.

The other examples of the material of the acicular fillers 123 include potassium titanate, wollastonite, sepiolite, acicular tin oxide, and acicular magnesium hydroxide.

Furthermore, it is desirable that the content of the acicular fillers 123 in the elastic layer 122 is 5% or more (5% by volume or more) and 40% or less (40% by volume or less). This is because if the content falls below 5% by volume, the thermal conductivity of the elastic layer 122 in the axial direction of the elastic roller 120 is low, so that the desired effect of reducing the temperature rise of the sheet non-passage portion cannot be achieved. Also, if the content exceeds 40% by volume, the elastic layer 122 becomes hardened and thus becomes hard to elastically deform, so that it becomes difficult to attain a desired fixing nip width at the nip portion N.

The content, the average length, and the thermal conductivity of the acicular fillers 123 can be obtained as follows.

A method for measuring the content (% by volume) of the acicular fillers 123 in the elastic layer 122 is as follows. First, the measurer clips an arbitrary portion of the elastic layer 122 and measures the volume of the clipped portion under an environment of 25° C. with an immersion specific gravity measurement apparatus (SGM-6, manufactured by Mettler-Toledo International Inc.). (Hereinafter, the measured volume is referred to as "$V_{all}$".) Then, the measurer heats the evaluation sample subjected to volume measurement at 700° C. for one hour under an atmosphere of nitrogen gas with a thermogravimetric measurement apparatus (trade name: TGA851e/SDTA, manufactured by Mettler-Toledo International Inc.) to decompose and remove silicone rubber components. The measurer extracts the acicular fillers 123 in the above-described way and then obtains the weight of the acicular fillers 123.

In a case where, in addition to the acicular fillers 123, inorganic fillers are contained in the elastic layer 122, the residues after decomposition include a mixture of acicular fillers and inorganic fillers.

In such a case, the measurer measures the volume under an environment of 25° C. with a dry auto densitometer (trade name: AccuPyc 1330-1, manufactured by Shimadzu Corporation) in the state where a mixture of acicular fillers and inorganic fillers is included. (Hereinafter, the measured volume is referred to as "$V_a$".) After that, the measurer heats the evaluation sample at 700° C. for one hour under an atmosphere of air to thermally decompose and remove the acicular fillers 123. Then, the measurer measures the volume of the inorganic fillers as residues under an environment of 25° C. with a dry auto densitometer (trade name: AccuPyc 1330-1, manufactured by Shimadzu Corporation). (Hereinafter, the measured volume is referred to as "$V_b$".) Based on the measured values, the weight of the acicular fillers 123 can be obtained by the following equation:

$$\text{Volume of acicular fillers (\% by volume)} = \{(V_a - V_b)/V_{all}\} \times 100$$

The average length of the acicular fillers 123 can be measured by a general method for observing, with a microscope, the acicular fillers 123 remaining after the heating removal of silicone rubber components.

The thermal conductivity of the acicular fillers 123 can be obtained by the following equation based on the thermal diffusivity, the isobaric specific heat, and the density:

$$\text{Thermal conductivity} = \text{Thermal diffusivity} \times \text{Isobaric specific heat} \times \text{Density}$$

The thermal diffusivity can be measured with a laser flash method thermal constant measurement apparatus (trade name: TC-7000, manufactured by ULVAC-RIKO, Inc.). The isobaric specific heat can be measured with a dry auto densitometer (trade name: AccuPyc 1330-1, manufactured by Shimadzu Corporation).

Furthermore, in the present exemplary embodiment, the measured values of the acicular fillers 123 include the content, the average length, and the thermal conductivity, which are obtained based on the average values of a total of five clipped samples.

[Voids]

The voids 124 according to the present exemplary embodiment are formed by using a method for forming voids using an aqueous material soaked with water in a water absorbing polymer (discussed in Japanese Patent Application Laid-Open No. 2002-114860). This is because a void forming method using a foaming agent or hollow particles may cause the disturbance of orientation of the acicular fillers 123.

Since the thermal conductivity in the width direction of the elastic layer 122 is greatly affected by the orientation state of the acicular fillers 123, if the orientation of the acicular fillers 123 is disturbed, the effect of reducing the temperature rise of the sheet non-passage portion decreases undesirably. On the other hand, in the case of the method for forming voids using an aqueous material, the orientation disturbance of acicular fillers can be reduced. In addition, since there are no hard shells as in the void forming method using hollow particles, the diameter of each void is small during the dispersion state of aqueous gel. Therefore, when the base polymer 126 is in a fluid state, the influence disturbing the orientation of the acicular fillers 123 is small. Furthermore, from a viewpoint of influences on strength and image quality, it is desirable that the diameter of each void 124 falls below 20 μm.

It is suitable that the void ratio in the elastic layer 122 is 20% or more (20% by volume or more) and 70% or less (70% by volume or less). In other words, a porosity of the elastic porous layer is 20% or more and 70% or less. If the void ratio falls below 20% by volume, it is difficult to achieve the desirable reduction effect of rise time. If a number of voids more than 70% by volume are intended to be formed, it is difficult to form the elastic layer 122. Since the higher the void ratio, the more reduced the rise time can be, the more desirable void ratio is 35% by volume or more and 70% by volume or less.

The void ratio in a region from the surface of the elastic layer 122 up to a depth of about 500 μm can be obtained as follows. First, the measurer clips, with a razor, a region from the surface of the elastic layer up to a depth of about 500 μm on an arbitrary surface to obtain the region as an evaluation sample. Then, the measurer measures the volume of the evaluation sample under an environment of 25° C. with an immersion specific gravity measurement apparatus (SGM-6, manufactured by Mettler-Toledo International Inc.) (the above-mentioned $V_{all}$).

Then, the measurer heats the evaluation sample subjected to volume measurement at 700° C. for one hour under an atmosphere of nitrogen gas with a thermogravimetric measurement apparatus (trade name: TGA851e/SDTA, manufactured by Mettler-Toledo International Inc.), thus decomposing and removing silicone rubber components. (Hereinafter, the weight decrease at this time is referred to as "Mp".) The measurer extracts the acicular fillers 123 in the above-described way and then obtains the weight of the acicular fillers 123.

In a case where, in addition to the acicular fillers 123, inorganic fillers are contained in the elastic layer 122, the residues after decomposition include a mixture of acicular fillers and inorganic fillers. In such a case, the measurer measures the volume under an environment of 25° C. with a dry auto densitometer (trade name: AccuPyc 1330-1, manufactured by Shimadzu Corporation) in the state where a mixture of the acicular fillers 123 and inorganic fillers is included (the above-mentioned $V_a$). Based on the measured values, the void ratio can be obtained by the following equation, in which the density of silicone polymer is assumed as 0.97 g/cm$^3$ (hereinafter, this density being referred to as "ρp"):

$$\text{Void ratio (\% by volume)}=[\{(V_{all}\}-(Mp\times\rho p+V_a)\}/V_{all}]\times 100$$

Furthermore, in the present exemplary embodiment, the measured values for the void ratio include the average values of a total of five evaluation samples.

[Measurement of Rise Time]

Next, the verification of the effect of shortening rise time in the present exemplary embodiment is described. The verification conducted here is a control experiment which was performed between the present exemplary embodiment and a comparative example 1 with varied configurations of the elastic roller 120 in the fixing apparatus 40 illustrated in FIG. 3.

In the elastic roller 120 according to the present exemplary embodiment, the content of the acicular fillers 123 was set to about 10% by volume, and the void ratio of the elastic layer 122 was set to about 45% by volume. As the elastic roller 120 according to the comparative example 1, a foaming adiabatic roller with a void ratio of 45% by volume in which the acicular fillers 123 were not added was used.

Figure 10:
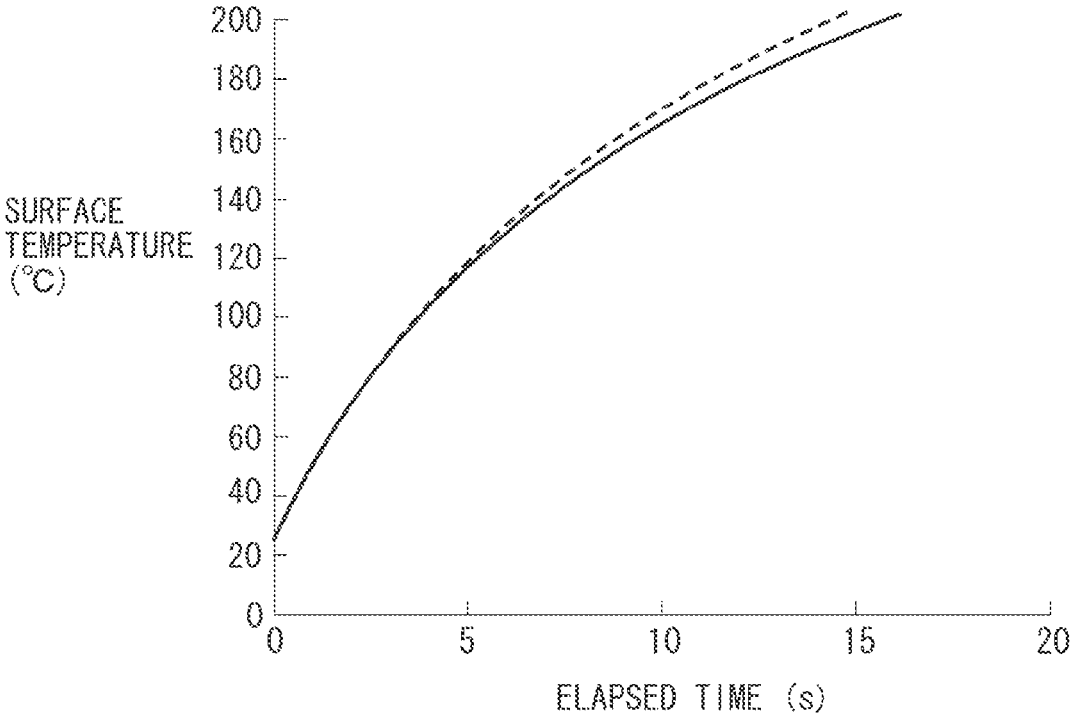
FIG. 10 is a graph illustrating a result of measurement of rise times according to the first exemplary embodiment and a comparative example 1.

Under the above two conditions, the manners of temperature rise of the surface of the fixing film 100 measured with a supplied power of 1100 W when the pressure roller 110 was being driven are illustrated in FIG. 10. FIG. 10 is a graph illustrating results of measurement of rise times in the present exemplary embodiment and the comparative example 1. In the graph of FIG. 10, the ordinate axis indicates the surface temperature (° C.) of the fixing film 100 and the abscissa axis indicates the elapsed time (s). The room temperature at this time was about 23° C., and the elapsed time was set to 0 seconds at the time of power-on.

The solid line in the graph of FIG. 10 indicates a rise temperature curve in the present exemplary embodiment, and the broken line indicates a rise temperature curve in the comparative example 1. In the graph of FIG. 10, a comparison between the manners of the rise temperature curves in the present exemplary embodiment and the comparative example 1 reveals approximately the same rise characteristics. Although as time goes on, the comparative example 1 exhibits a somewhat superior characteristic, it is within a range of tolerance. This is because the target temperature of the fixing film 100 at the time of actual use is 150° C. and the rise time taken up to the attainment of the target temperature is about 7 seconds in both of the present exemplary embodiment and the comparative example 1.

[Measurement of Temperature Rise of Sheet Non-passage Portion]

Figure 11:
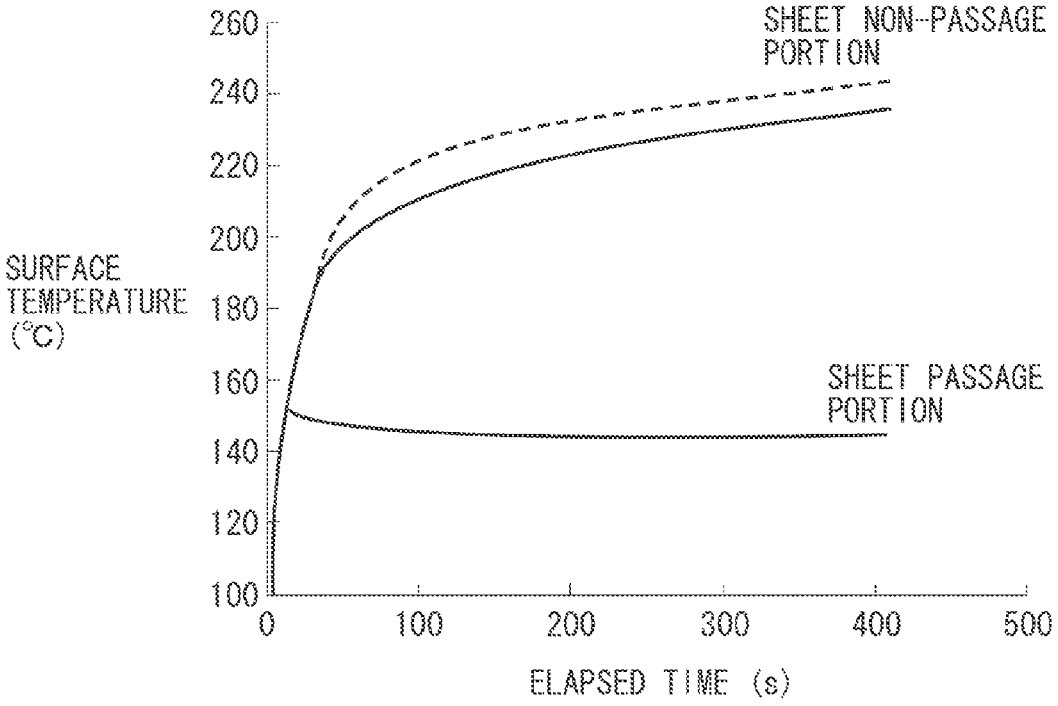
FIG. 11 is a graph illustrating a result of measurement of temperatures at a sheet non-passage portion according to the first exemplary embodiment and the comparative example 1.
Figure 12:
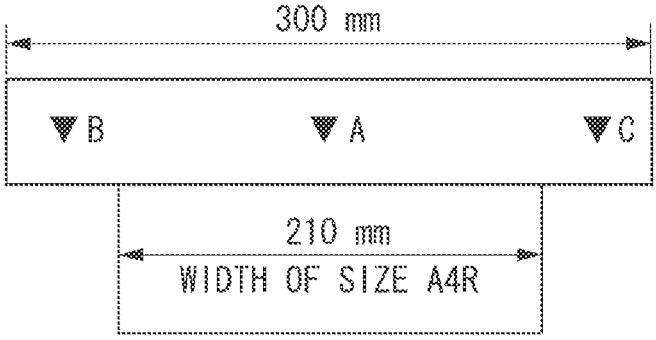
FIG. 12 is an explanatory diagram illustrating a positional relationship between the fixing film and a sheet.

Next, the verification of the effect of reducing the temperature rise of the sheet non-passage portion in the present exemplary embodiment is described. The verification conducted here is a control experiment which was performed between the present exemplary embodiment and the comparative example 1 with varied configurations of the elastic roller 120 in the fixing apparatus 40 illustrated in FIG. 3. FIG. 11 is a graph illustrating results of measurement of temperatures of the sheet non-passage portion of the fixing film 100 in the present exemplary embodiment and the comparative example 1. FIG. 12 is an explanatory diagram illustrating the positional relationship between the fixing film 100 and the sheet P.

In the elastic roller 120 according to the present exemplary embodiment, the content of the acicular fillers 123 was set to about 10% by volume, and the void ratio of the elastic layer 122 was set to 45% by volume. As the elastic roller 120 according to the comparative example 1, a foaming adiabatic roller with a void ratio of 45% by volume in which the acicular fillers 123 were not added was used.

Under the above two conditions, the manners of temperature rise of the sheet non-passage portion measured when 200 pieces of plain paper of A4R size (80 g/mm$^2$) as the sheet P have continuously passed at a speed of 30 pages per minute (PPM) are illustrated in FIG. 11. In the graph of FIG. 11, the ordinate axis indicates the surface temperature (° C.) of the fixing belt (fixing film) and the abscissa axis indicates the elapsed time (s). The temperature of the sheet passage portion at this time was controlled to be the same between the present exemplary embodiment and the comparative example 1. In FIG. 11, the solid line indicates a result of measurement in the present exemplary embodiment and the broken line indicates a result of measurement in the comparative example 1.

These results reveal that the temperature of the sheet non-passage portion in the present exemplary embodiment is about 10° C. lower than the temperature of the sheet non-passage portion in the comparative example 1. Accordingly, it can be confirmed that when the acicular fillers 123 are contained only at 10% by volume in the elastic roller 120, an improvement effect for 10° C. can be attained.

In the present exemplary embodiment, the sheet P of A4R size was used for the verification. However, similar advantageous effects were obtained even when sheets P of various width sizes, such as postcard, A5, B4, and A4, were used for the verification. Furthermore, in the present exemplary embodiment, plain paper was used as the sheet P for the verification. However, similar advantageous effects were obtained even when other type sheets, such as thick paper and thin paper, were used for the verification.

The temperature of the sheet passage portion is the temperature of a portion in the vicinity of the center of the fixing film 100, through which the sheet P passes. The temperature of the sheet non-passage portion is the temperature of each end region of the fixing film 100, through which the sheet P does not pass. More specifically, in the fixing film 100 with a width of about 300 mm, a central region with a width of about 210 mm, through which the sheet P of A4R size passes, is the sheet passage portion (passage region). Also, in the fixing film 100, a region through which the sheet P of A4R size does not pass is the sheet non-passage portion (non-passage region). Point A illustrated in FIG. 12 is located at the center of the passage region, and the temperature measured at this point corresponds to the temperature of the sheet passage portion. Points B and C are respectively located at the central portions of non-passage regions, which are the end regions of the fixing film 100, and an average value of the temperatures measured at these points corresponds to the temperature of the sheet non-passage portion.

The verification of the effect of shortening rise time and the effect of reducing the temperature rise of the sheet non-passage portion in the present exemplary embodiment has been described above.

Table 1 is a table for comparison in characteristic among the above-described verification results and, in addition, a verification result in a comparative example 2 in which an elastic roller 120 formed of soli-type silicone rubber having no voids is used.

TABLE 1

| | First Exemplary Embodiment | Comparative Example 1 | Comparative Example 2 |
|---|---|---|---|
| Rise Time | B | B | D |
| Temperature Rise of Sheet Non-passage Portion | B | D | B |
| Comprehensive Results | A | C | C |

A = Very good
B = Good
C = Average
D = Poor

According to Table 1, in the case of the present exemplary embodiment, both the effect of shortening rise time and the effect of reducing the temperature rise of the sheet non-passage portion are good. On the other hand, in the case of the comparative example 1, the effect of reducing the temperature rise of the sheet non-passage portion is poor. In the case of comparative example 2, the effect of shortening rise time is poor.

Thus, Table 1 indicates good results in the present exemplary embodiment with respect to both of the effect of shortening rise time and the effect of reducing the temperature rise of the sheet non-passage portion.

Therefore, according to the present exemplary embodiment, the temperature rise of the sheet non-passage portion of the fixing film 100 that would occur when small-size sheets P are continuously subjected to a fixing process can be reduced. Also, according to the present exemplary embodiment, the rapid rise characteristics of the fixing film 100 can be maintained. Furthermore, according to the present exemplary embodiment, both the rapid rise characteristics of the fixing film 100 and the reduction of the temperature rise of the sheet non-passage portion can be satisfied.

A second exemplary embodiment is described below. In the first exemplary embodiment, a configuration in which the elastic roller 120 is located inside the fixing film 100 that generates heat has been described. In the present, second exemplary embodiment, an example of a configuration in which the elastic roller 120 is located inside a fixing film 100 that generates heat by electromagnetic induction is described.

Figure 13:
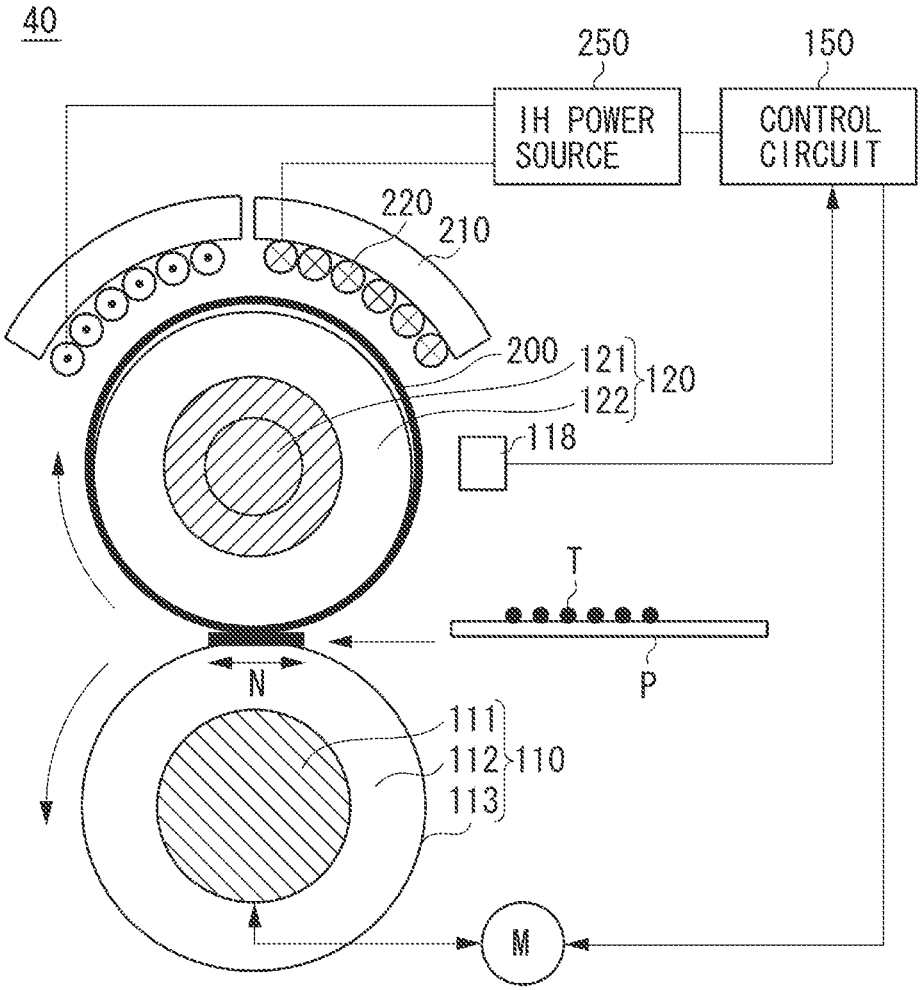
FIG. 13 is a sectional view illustrating a configuration of a fixing apparatus according to a second exemplary embodiment.

FIG. 13 illustrates a basic configuration of a fixing apparatus 40 according to the second exemplary embodiment. In the second exemplary embodiment, the basic configuration of the fixing apparatus 40 including the elastic roller 120 and the pressure roller 110 is similar to that in the first exemplary embodiment except for a configuration of a fixing belt 200 and a configuration for causing the fixing belt 200 to generate heat. In the following description, components similar to those of the first exemplary embodiment are assigned with the same reference numerals, and the description thereof is not repeated.

The fixing belt 200, which serves as a heating film (heating member), is an endless belt (film) having a metal layer. The pressure roller 110 is located in such a way as to contact the outer circumference of the fixing belt 200. The elastic roller 120, which is located inside the fixing belt 200, presses the pressure roller 110 via the fixing belt 200 to form a nip portion N.

The fixing apparatus 40 according to the present exemplary embodiment nips and conveys a sheet P at the nip portion N. The fixing apparatus 40 then applies heat and pressure to the sheet P to heat and fix an image formed on the sheet P onto the sheet P.

The fixing belt 200 according to the present exemplary embodiment is composed of a metal layer (not illustrated), an elastic layer (not illustrated) provided on the outer circumference of the metal layer, and a release layer (not illustrated) provided on the outer circumference of the elastic layer. The thickness of the metal layer can be adjusted depending on the frequency of a high-frequency current flowing through an exciting coil 220 and the magnetic permeability and electric conductivity of the metal layer, and can be set to within a range of 5 to 20 μm. Examples of the material of the metal layer include nickel, iron alloy, copper, and silver. The metal layer in the present exemplary embodiment is a nickel material with a diameter of about 30 mm and a thickness of about 40 μm. Examples of the material of the elastic layer include rubber. The elastic layer in the present exemplary embodiment is a heat-resistant silicone rubber with a thickness of about 300 μm, a hardness of about 20 degrees in JIS-A, and a thermal conductivity of about 0.8 W/mK. Examples of the release layer include a fluororesin layer. The release layer in the present exemplary embodiment is a PFA layer with a thickness of about 30 μm.

As illustrated in FIG. 13, the exciting coil 220 is an electric wire arranged to face the outer circumferential surface of the fixing belt 200 and wound along the width direction of the fixing belt 200.

A high-frequency current of 20 to 50 kHz is applied to the exciting coil 220, which serves as a heat generation device that causes the fixing belt 200 to generate heat. The exciting coil 220 generates a magnetic field corresponding to the high-frequency current.

A magnetic material core 210 functions to efficiently guide an alternating-current magnetic flux generated by the exciting coil 220 to the fixing belt 200. The material of the magnetic material core 210 can be a magnetic material with a high magnetic permeability and a low residual magnetic flux density. The magnetic material core 210 in the present exemplary embodiment is made of ferrite.

The thermistor 118, which is a temperature sensor, detects the surface temperature of the fixing belt 200. Then, the thermistor 118 transmits a result of detection to the control circuit 150.

An induction heating (IH) power source 250 applies a high-frequency current of 20 to 50 kHz to the exciting coil 220 when the fixing belt 200 is rotating.

The pressure roller 110 is mechanically connected to the motor M. When the motor M is driven upon receiving energization by the control circuit 150, the pressure roller 110 is driven to rotate in the direction of arrow in FIG. 13 (counterclockwise). Then, the pressure roller 110, when rotating, causes the fixing belt 200 to be driven to rotate in the direction of arrow in FIG. 13 (clockwise) due to a friction at the nip portion N. Also, as the fixing belt 200 rotates, the elastic roller 120, which contacts the inner surface of the fixing belt 200, is driven to rotate in the direction of arrow in FIG. 13 (clockwise) due to a friction against the inner surface of the fixing belt 200.

The control circuit 150 is connected to the motor M, the IH power source 250, and the thermistor 118 in such a way as to exchange signals therebetween.

The control circuit 150 periodically samples an output from the thermistor 118, and controls the IH power source 250 based on the temperature of the fixing belt 200 detected by the thermistor 118. More specifically, the control circuit 150 adjusts an effective voltage to be applied to the IH power source 250 in such a manner that the temperature detected by the thermistor 118 is kept at the target temperature used for a fixing process (150° C. in the present exemplary embodiment).

As the effective voltage applied to the IH power source 250 lowers, the current flowing through the exciting coil 220 decreases, and a magnetic flux generated by the exciting coil 220 decreases. As the magnetic flux generated by the exciting coil 220 decreases, the amount of heat generation of the fixing belt 200 also decreases. As the effective voltage applied to the IH power source 250 increases, the current flowing through the exciting coil 220 increases, and a magnetic flux generated by the exciting coil 220 increases.

In the above-described way, the temperature of the fixing belt 200 is controlled by the control circuit 150.

The control circuit 150 controls the manner of energization to the motor M during image formation to drive the fixing belt 200, the pressure roller 110, and the elastic roller 120 to rotate at respective predetermined speeds. Accordingly, the sheet P subjected to the fixing process is nipped and conveyed between the fixing belt 200 and the pressure roller 110 at a predetermined process speed.

When the verification similar to that in the first exemplary embodiment was performed in the fixing apparatus 40 in the second exemplary embodiment, the effect similar to that in the first exemplary embodiment was able to be confirmed.

Therefore, according to the present exemplary embodiment, the temperature rise of the sheet non-passage portion of the fixing belt 200 that would occur when small-size sheets P are continuously subjected to a fixing process can be reduced. Also, according to the present exemplary embodiment, the rapid rise characteristics of the fixing belt 200 can be maintained. Furthermore, according to the present exemplary embodiment, both the rapid rise characteristics of the fixing belt 200 and the reduction of the temperature rise of the sheet non-passage portion can be satisfied.

Figure 14:
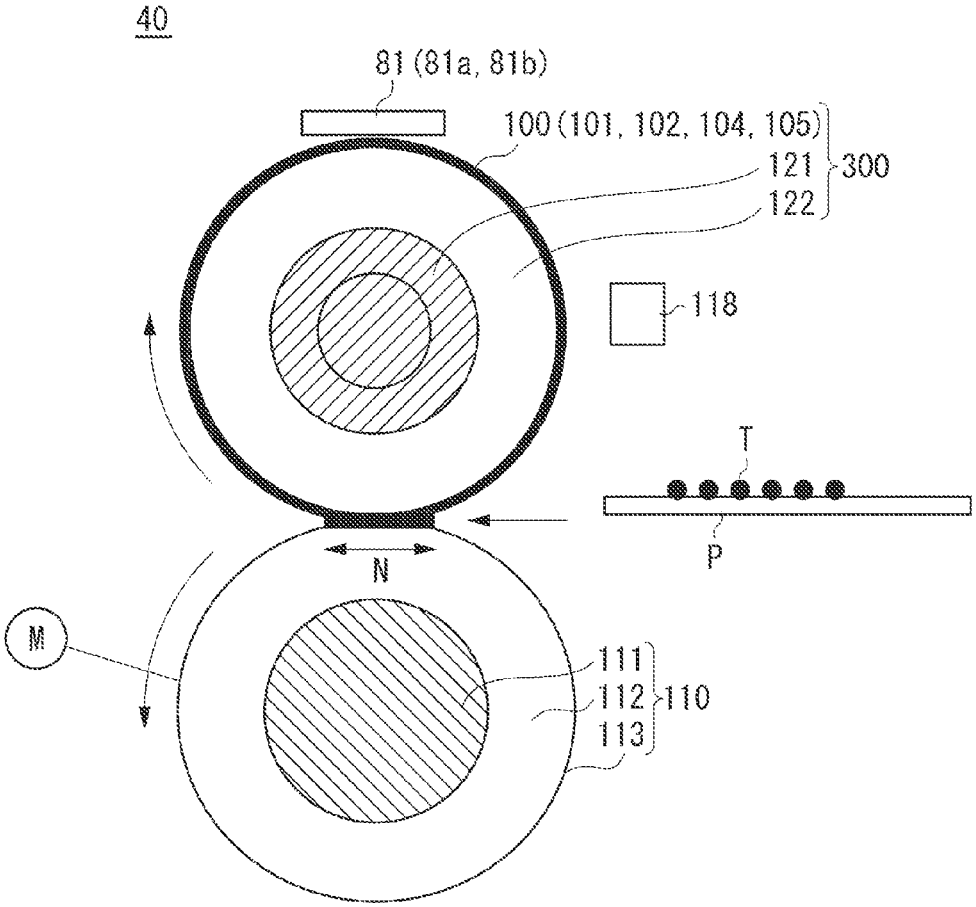
FIG. 14 is a sectional view illustrating a configuration of a fixing apparatus according to a third exemplary embodiment.
Figure 15:
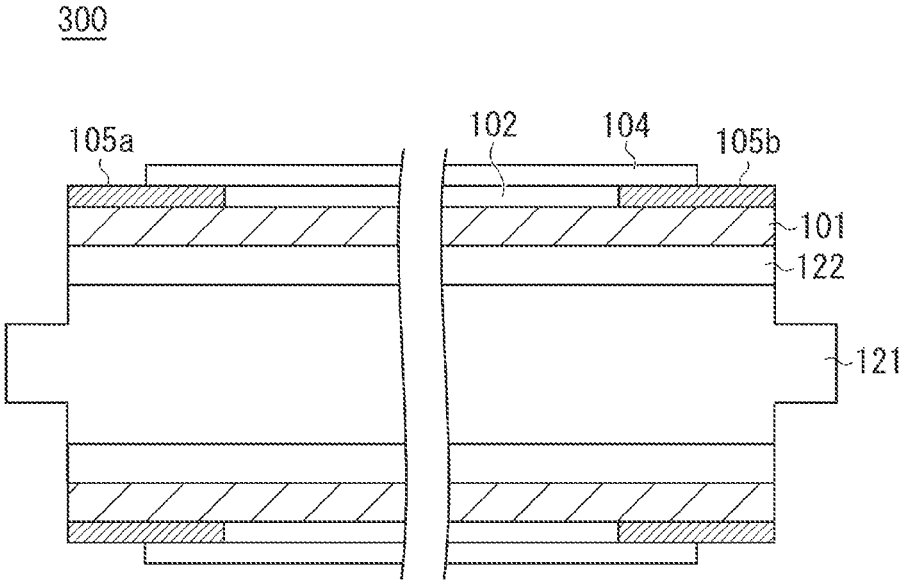
FIG. 15 is a sectional view illustrating a layer configuration of a fixing roller according to the third exemplary embodiment.

A fixing apparatus according to a third exemplary embodiment is described below. FIG. 14 is a sectional view illustrating a configuration of the fixing apparatus 40 according to the third exemplary embodiment. FIG. 15 is a sectional view illustrating a layer configuration of a fixing roller 300. In the first exemplary embodiment, the fixing apparatus 40 in which the elastic roller 120 having the elastic layer 122 is caused to contact the inner circumferential surface of the fixing film 100 having the heat generation layer 102 has been described. In the third exemplary embodiment, the fixing apparatus 40 in which the fixing roller 300 having the heat generation layer 102 and the elastic layer 122 is used is described. The third exemplary embodiment with the above-described configuration can solve such an issue that the fixing film 100 may move in the axial direction in a one-sided manner as in the first exemplary embodiment. The fixing apparatus 40 according to the third exemplary embodiment has a configuration similar to the basic configuration of the fixing apparatus 40 in the first exemplary embodiment. In the following description, components similar to those of the first exemplary embodiment are assigned with the same reference numerals, and the description thereof is not repeated.

The fixing roller 300, which serves as a heating member (heating roller), is configured to generate heat by electrical resistance with energization to the heat generation layer 102, thus heating an image T on the sheet P at the nip portion N. The outer diameter of the fixing film 100 in the present exemplary embodiment is about 30 mm, and the length thereof in the width direction (the near-far direction in FIG. 14 or the rotational axis direction) except for the core metal 121 is about 300 mm. The fixing roller 300 in the present exemplary embodiment is configured to be driven to rotate by the driving rotation of the pressure roller 110. However, the fixing roller 300 may be configured to be directly driven by the motor M.

The fixing roller 300 in the present exemplary embodiment has a multi-layer composite structure including the core metal 121, the elastic layer 122, the base layer 101, the heat generation layer 102, and the release layer 104 in order from the rotation axis to the outer circumference. Furthermore, electrodes 105*a* and 105*b* are respectively arranged at the two end portions in the width direction of the fixing roller 300 in place of the heat generation layer 102.

The core metal 121 is a shaft-like member made of stainless steel. The two end portions in the axial direction of the core metal 121 are rotatably held by a pressure mechanism (not illustrated) via rotation bearings (not illustrated). As the pressure mechanism presses the two end portions of the core metal 121 toward the pressure roller 110, the elastic layer 122 presses the pressure roller 110 via the fixing film 100.

The elastic layer 122 is a layer provided on the core metal 121 and containing, as a base, a base polymer 126 made of silicone rubber. In the present exemplary embodiment, the thickness of the elastic layer 122 is set to about 3 mm. The elastic layer 122 contains voids 124 and acicular fillers 123 in the base polymer 126. With this configuration, the elastic layer 122 has such a configuration that the thermal conductivity is high in the longitudinal direction thereof and low in the radial direction thereof.

The base layer 101, which serves as a base for supporting the heat generation layer 102, the electrode 105*a*, and the electrode 105*b*, is made of a heat-resistant material. The base layer 101 in the present exemplary embodiment is a layer with a thickness of about 30 μm made of polyimide. The inner circumferential surface of the base layer 101 is bonded to the elastic layer 122 by heat-resistant adhesive. In the present exemplary embodiment, adhesive made of silicone resin is used.

In the present exemplary embodiment, the elastic layer 122 is bonded to the entire area of the inner circumferential surface of the base layer 101. However, the elastic layer 122 may be bonded to only a part of the base layer 101 (for example, an end portion in the width direction).

The release layer 104 is provided to improve the separation property of the sheet P. In the present exemplary embodiment, a PFA tube with a thickness of about 20 μm is used as the release layer 104. Furthermore, the release layer 104 is bonded to the heat generation layer 102 by adhesive made of silicone resin.

The heat generation layer 102, which is a resistance heat generation layer, is a resistance heating element that generates heat upon energization. The heat generation layer 102 can be formed by applying, at a uniform thickness onto the base layer 101, polyimide resin containing carbon as conductive particles.

The electrodes 105 (105*a* and 105*b*) are conductive regions of the fixing film 100 that electrically connect to the power feeding members 81 by contacting the power feeding members 81. The electrodes 105 are respectively connected to the two ends of the heat generation layer 102.

When the verification similar to that in the first exemplary embodiment was performed in the fixing apparatus 40 using the fixing roller 300, the effect similar to that in the first exemplary embodiment was able to be confirmed.

Therefore, according to the present exemplary embodiment, the temperature rise of the sheet non-passage portion of the fixing roller 300 that would occur when small-size sheets P are continuously subjected to a fixing process can be reduced. Also, according to the present exemplary embodiment, the rapid rise characteristics of the fixing roller 300 can be maintained. Furthermore, according to the present exemplary embodiment, both the rapid rise characteristics of the fixing roller 300 and the reduction of the temperature rise of the sheet non-passage portion can be satisfied.

Moreover, according to the present exemplary embodiment, as described above, such an issue that the fixing film 100 may move in the axial direction in a one-sided manner as in the first exemplary embodiment can be solved. Therefore, in terms of solving such an issue, the configuration of the third exemplary embodiment is desirable.

However, in the third exemplary embodiment, since the elastic layer 122 and the base layer 101 are bonded to each other by adhesive, the thermal capacity of the heating member may increase. Furthermore, in the third exemplary embodiment, since the elastic layer 122 and the base layer 101 are bonded to each other by adhesive, stress concentration may occur at the elastic layer 122, so that load applied to the elastic layer 122 may decrease the durability of the elastic layer 122. Therefore, in terms of low thermal capacity and long durability, the configuration of the first exemplary embodiment is desirable.

In the present exemplary embodiment, the core metal 121 and the elastic layer 122 are integrated as a unit. However, the fixing apparatus 40 can have another configuration. For example, the core metal 121 and the elastic layer 122 can be made as separate units. In other words, the core metal 121 and the elastic layer 122 need not be bonded to each other. In this instance, the fixing apparatus 40 has such a configuration that the core metal 121 presses, toward the pressure roller 110, a hollow roller that is composed of the elastic layer 122, the base layer 101, the heat generation layer 102, the release layer 104, and the electrodes 105. In addition, a sliding layer made of polyimide can be provided on the inner circumferential surface of the elastic layer 122, and a pad member that slides on the sliding layer can be used as a pressure member in place of the core metal 121.

While various exemplary embodiments of the present invention have been described above, the configurations described in the exemplary embodiments can be modified as appropriate within a range to which the present invention can be applied.

A belt unit including a fixing film 100 stretched between a plurality of elastic rollers 120 can be used. However, in terms of low thermal capacity, a configuration the inner surface of which is supported by a single elastic roller 120 as in the first exemplary embodiment is desirable.

The member that forms the nip portion N in association with the fixing film 100 is not limited to a roller-shaped member, such as the pressure roller 110. For example, the member can be a pressure belt supported by a plurality of support rollers.

The heating film is not limited to a member, such as the fixing film 100, that is driven to rotate by the pressure roller 110. For example, the heating film can be a member that is driven to rotate by an elastic roller 120 that is rotated by the motor M. In addition, the pressure roller 110 and the elastic roller 120 can be configured to independently rotate.

The image forming apparatus, which has been described with the printer 1 taken as an example, is not limited to an image forming apparatus that forms a full-color image, but may be an image forming apparatus that forms a monochromatic image. In addition, the image forming apparatus can be implemented in various applications, such as a copying machine, a facsimile machine, and a multifunction peripheral, with the addition of the required device, equipment, and casing configuration.

The above-described image heating apparatus is not limited to an apparatus that fixes an unfixed toner image T onto the sheet P. For example, the image heating apparatus can be an apparatus that fixes a semi-fixed toner image T onto the sheet P or an apparatus that applies a heating process to a fixed image. Therefore, the fixing apparatus 40, which serves as an image heating apparatus, can be, for example, a surface heating apparatus that adjusts the gloss or surface property of an image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2013-246806 filed Nov. 28, 2013 and No. 2014-135333 filed Jun. 30, 2014, which are hereby incorporated by reference herein in their entirety.

What is claimed is:

1. An image heating apparatus comprising:

an endless belt configured to heat an image on a sheet at a nip potion;

a heat generation device configured to cause the belt to generate heat;

a nip forming member configured to form the nip portion between the nip forming member and the belt; and a pressing roller configured to press an inner surface of the belt toward the nip forming member, the pressing roller including an elastic porous layer containing a plurality of filler particles, wherein a thermal conductivity of the elastic porous layer in an axial direction of the pressing roller is in a range of 6 times to 900 times a thermal conductivity of the elastic porous layer in a radial direction of the pressing roller.

2. The image heating apparatus according to claim 1, wherein the thermal conductivity of the elastic porous layer is in a range of 0.08 W/(m·K) or greater and 0.4 W/(m·K) or less in the radial direction of the pressing roller, and 0.48 W/(m·K) or greater and 360 W/(m·K) or less in the axial direction of the pressing roller.

3. The image heating apparatus according to claim 1, wherein a porosity of the elastic porous layer is in a range of 20% or greater to 70% or less.

4. The image heating apparatus according to claim 1, wherein a ratio by volume of the plurality of filler particles in the elastic porous layer is in a range of 5% or greater to 40% or less.

5. The image heating apparatus according to claim 1, wherein, in a circumferential direction of the belt, a width at which the belt and the pressing roller contact each other is longer than a width of the nip portion.

6. The image heating apparatus according to claim 1, wherein the nip forming member is a driving rotator configured to drive the belt, and wherein the pressing roller is driven to rotate by the belt.

7. The image heating apparatus according to claim 1, wherein the belt includes a resistance heat generation layer configured to generate heat upon receiving power, and wherein the heat generation device is a power feeding device configured to supply power to the belt.

8. A heating member comprising:

a heat generation layer configured to generate heat to heat an image on a sheet; and an elastic porous layer provided inside the heat generation layer in a thickness direction of the heating member, the elastic porous layer containing a plurality of voids and a plurality of filler particles, wherein a thermal conductivity of the elastic porous layer in a longitudinal direction of the heating member is in a range of 6 times to 900 times a thermal conductivity of the elastic porous layer in a thickness direction of the heating member.

9. The heating member according to claim 8, wherein the thermal conductivity of the elastic porous layer is in a range of 0.08 W/(m·K) or greater to 0.4 W/(m·K) or less in the thickness direction of the heating member, and 0.48 W/(m·K) or greater to 360 W/(m·K) or less in the longitudinal direction of the heating member.

10. The heating member according to claim 8, wherein a porosity of the elastic porous layer is in a range of 20% or greater to 70% or less.

11. The heating member according to claim 8, wherein a ratio by volume of the plurality of filler particles in the elastic porous layer is in a 5% or greater to 40% or less.

12. The heating member according to claim 8, wherein the heating member is a heating roller.

13. An image heating apparatus comprising:

the heating member according to claim 8; and a heat generation device configured to cause the heating member to generate heat.

14. A pressing roller that is usable in an image forming apparatus including an endless belt configured to heat an image on a sheet at a nip potion, and a nip forming member configured to form the nip portion between the nip forming member and the belt, the pressing roller comprising:

an elastic porous layer containing a plurality of voids and a plurality of filler particles, wherein a thermal conductivity of the elastic porous layer in an axial direction of the pressing roller is in a range of 6 times to 900 times a thermal conductivity of the elastic porous layer in a radial direction of the pressing roller.

15. The pressing roller according to claim 14, wherein the thermal conductivity of the elastic porous layer is in a range of 0.08 W/(m·K) or greater to 0.4 W/(m·K) or less in the radial direction of the pressing roller, and in a range of 0.48 W/(m·K) or greater to 360 W/(m·K) or less in the axial direction of the pressing roller.

16. The pressing roller according to claim 14, wherein a porosity of the elastic porous layer is in a range of 20% or greater to 70% or less.

17. The pressing roller according to claim 14, wherein a ratio by volume of the plurality of filler particles in the elastic porous layer is in a range of 5% or greater to 40% or less.

* * * * *